United States Patent [19]

van der Linden

[11] 4,385,749

[45] May 31, 1983

[54] METHOD AND A DEVICE FOR REPAIRING THE TAP HOLE OF A STEEL CONVERTER

[76] Inventor: Gerardus A.C. van der Linden, 86, Wenckebachstraal, Velsen, Netherlands

[21] Appl. No.: 258,055

[22] Filed: Apr. 28, 1981

Related U.S. Application Data

[63] Continuation-in-part of Ser. No. 141,471, Apr. 18, 1980, abandoned, which is a continuation of Ser. No. 442,454, Feb. 14, 1974, abandoned, which is a continuation of Ser. No. 137,849, Apr. 27, 1971, abandoned.

[30] Foreign Application Priority Data

Apr. 28, 1970 [NL] Netherlands ..... 7006218

[51] Int. Cl.[3] ..... C21C 5/44

[52] U.S. Cl. ..... 266/45; 264/30; 264/36; 264/269

[58] Field of Search ..... 264/30, 36, 265, 269; 106/56; 266/42, 43, 45

[56] References Cited

U.S. PATENT DOCUMENTS

| | | | |
|---|---|---|---|
| 2,608,501 | 8/1952 | Kimble | 264/269 X |
| 3,193,402 | 7/1965 | Rusoff | 106/56 |
| 3,351,289 | 11/1967 | De Maison | 264/30 X |
| 3,356,108 | 12/1967 | Johnston | 264/269 X |
| 3,458,607 | 7/1969 | Sullivan | 264/30 |
| 3,531,098 | 9/1970 | Resch | 264/30 X |
| 3,563,523 | 2/1971 | Wendt | 264/30 X |
| 3,663,669 | 5/1972 | McConnell | 264/30 |
| 3,737,489 | 6/1973 | Murton | 266/43 X |

*Primary Examiner*—Thomas P. Pavelko

*Attorney, Agent, or Firm*—Hall & Houghton

[57] ABSTRACT

A method and apparatus is provided for repairing the worn tap hole of a steel converter to restore same to a desired diameter wherein elongated jet spray means are placed centrally into and in close proximity to the surface of the damaged tap hole and thereafter refractory mortar repair material is sprayed against the surface of the inner circumference of the worn tap hole wall to restore the diameter of same to the desired dimension.

12 Claims, 3 Drawing Figures

METHOD AND A DEVICE FOR REPAIRING THE TAP HOLE OF A STEEL CONVERTER

RELATED APPLICATIONS

This application is a continuation-in-part of application Ser. No. 141,471 filed Apr. 18, 1980, now abandoned which was a continuation of application Ser. No. 442,454, filed Feb. 14, 1974, now abandoned, which in turn, was a continuation of application Ser. No. 137,849, filed Apr. 27, 1971, now abandoned.

BACKGROUND OF THE INVENTION

The present invention relates to a method and apparatus for restoring the tap hole of a steelmaking converter to a proper dimensional size after same has become worn due to use. In steel converters, particularly those which are used for refining by the oxygen lance process in which oxygen is blown into a molten bath of steel, the tap hole is, as a general rule, positioned in the upper half of the side wall of the converter. By tilting the converter, the molten charge therein will thereafter flow in a molten state from the reactor through the tap hole.

Such tap holes are formed generally by use of a so-called tap hole brick which is secured in a recess in the brickwork of the converter with the aid of granular or powdery refractory substance applied by ramming (monolithic lining, stampfmasse or pise'). The tap hole brick employed therein consists of a cylindrical brick provided therein with a central bore, such bricks generally being made of magnesite. After the converter has been tilted, the molten steel flows out through the central bore in the tap hole brick, the time required to pass the molten steel through the tapping hole depending primarily on the diameter of the central bore in the tap hole brick.

As a result of the molten steel flowing out of the formed tap hole, there will be an erosion of the wall of the hole and thus the diameter of the tap hole will gradually increase in size as a result of such operation. The shape of the tap hole also may change so as to deviate from the normally cylindrical shape of the hole. Thus, after the tap hole has become too enlarged, the tap hole becomes unsuitable for further use. This wear and erosion of the tap hole of the converter is highly undesirable since it will result in too short a tapping time, this being the consequence of a too wide or enlarged tap hole in the converter through which the molten metal will flow.

The fact that a too short tapping time will occur will also mean that a period of time will arise which will be too short for uniformly dissolving alloying materials into the molten steel which is generally added after the beginning of the tapping operation. This operation, resulting in too short a tapping time, is undesirable from a metallurgical standpoint. Another drawback resulting from a too wide or an enlarged tap hole is that the wall of the tap hole brick oftentimes becomes too thin and thus the wall thereof can break through or otherwise be damaged at a given moment. Therefore, from an operational standpoint, after the tap hole has reached a certain critical diameter due to erosion from the molten metal flowing therethrough, the tap hole brick should be repaired to restore the desired dimension to the tap hole or, otherwise, replaced.

As a result of the repairing methods that have been employed heretofore, it was found to be generally desirable to postpone the repair of a damaged tap hole in a converter as long as possible. One practice that has been employed heretofore to minimize the problem of the tap hole erosion has been that in the initial operation of the converter, to use a tap hole brick having a central bore therein which is smaller than the desired opening. Such practice had the advantage that only after several charges have passed through the tap hole, the desired critical upper dimensional limits of the diameter of the tap hole would be reached.

A typical repairing procedure for repairing a worn tap hole that has been employed heretofore is that when the repairing is to occur, the converter is shut down and then placed in a tilted position. A mold is then positioned from the outside of the converter into the damaged tap hole. Such a mold comprises a core which extends into and through the damaged tap hole and which has an outer diameter which corresponds to that of the desired inner diameter of the tap hole after the repair thereof has been made. After insertion of the mold into the tap hole, liquid repair material is then cast, with the aid of long handled spoons or ladles, through the large mouth or filling opening of the converter and into the annular space left free between the core of the mold and the wall of the tap hole to be repaired. The repair material contains a liquid dispersion or mixture of refractory material and a suitable binder which, after evaporation of the liquid therefrom, constitutes the refractory layer which is built up in the clearance or annular space between the core of the mold and the wall of the tap hole to be repaired. The mold is then removed from the repaired tap hole, after which the tap hole has thus been restored to its original dimensions and is in a condition for use with a number of charges. The positioning and removing of the mold in the worn tap hole is a time consuming operation and the manipulation with the long handled and heavy spoon or ladle containing the repair material before the hot converter mouth by personnel positioned before the very hot converter mouth is particularly undesirable to the worker from an operational and health standpoint. Therefore, the repairing of the tap hole in the manner above-described is a reason for postponing the operation for as long as possible.

By way of an illustration of the mold repairing procedure above-described, a typical converter is provided which is suitable for steel charges up to about 300 tons, with the converter having a bore diameter for the tap hole brick of about 150 mm. The normal tapping time for a converter having a tap hole of this dimension is about 11 minutes, which tapping time, however, after 60 to 70 charges have been discharged from the converter through the tap hole, has been reduced to about 5 minutes. The eroded tap hole must then be repaired to restore the converter operation to its normal state by having the bore size of the tap hole restored to its original dimension. The repairing of the tap hole will then be carried out in the manner hereinbefore described utilizing the mold procedure, after which the tapping time will be again about 11 minutes. After each repairing, however, it is possible to tap only about 20 charges before the tapping time of the converter has been reduced again to 5 minutes and the tap hole again repaired.

The just-described method of operating the converter and of repairing the tap hole after same has become worn, by utilizng a mold, is generally undesirable for various reasons. For example, a large number of charges will be tapped from the converter with long tapping times existing, a result of which is that there will be a corrosive attack on the converter wall lining by the slag floating on top of the steel. This fact is particularly undesirable since there will be a damaging effect on the lining since the attack will occur for a relatively long period of time. Therefore, it will be found desirable to restrict this so-called time of attack on the converter wall lining by the slag as much as possible. The desirability for minimizing this period of contact is that the attack time on the converter lining by the slag will also be determinative of the operational life of the refractory lining of the converter. This means that long tapping times and, therefore, long aggression or attack periods of time on the converter lining by the slag will result in the converter, after a fewer number of charges than desired have been made, having to be taken out of operation in order to be relined and provided with new bricks. Therefore, not only is the availability of the converter decreased as a result of the attack on the lining but, in addition, the costs of repair will result in a decrease in the production rate of the steel and a corresponding increase in the cost of the steel.

Another drawback with this prior method of repairing an eroded tap hole utilizing a mold is that, on the average, the longer tapping times decrease the availability of the converter, which will, in turn, result in a lower steel production per converter. Yet another drawback with this procedure is that the metallurgical control of the charge is quite difficult to achieve when the tapping times of the converter are found to vary considerably. Still another material drawback utilizing the mold repairing procedure is that the operating personnel must operate, when repairing the worn tap hole, quite close to the mouth of the converter, utilizing a bucket-shaped spoon having a long shank having a length of about 8 m. with the bucket-shaped spoon, when filled, weighing about 60 kg.

There have been other procedures that have been employed heretofore commercially or proposed for use in the repairing of eroded or worn tap holes in a converter. All of such prior procedures have been predicated on the philosophy that the tap hole should remain in use as long as possible even though it may become badly eroded and quite enlarged. When the tap hole has reached a state of erosion that it is impossible to use further, the converter will then be shut down and the tap hole will then be completely rebuilt or the tap hole brick replaced. Obviously, such a procedure is economically and operationally undesirable even though the shutdown period may be for only a short time.

In the first instance, the shutting down of the converter stops the steel production completely. Secondly, if the shutdown is for only a short period of time, problems are still created. For example, temperature is one of the most critical factors in steelmaking and a cooling thereof, even for a short time, will impair the steelmaking production.

Another critical factor in steelmaking production is that the tapping time of the converter will be materially affected by a complete shutdown of the converter for even a short period of time or by a gradual and extensive enlargement of the tap hole. The tapping time of a converter is a very critical factor in a steelmaking operation. The reason for this is that the tapping time and the tapping speed determine factors such as temperature of the tapped steel, carbon content and efficiency of additions of alloying materials which will effect the ultimate end product. Also, if the steelmaking process is controlled by a computer program, which in modern steelworks is not unusual, the tapping time is one of the essential parameters in the steelmaking procedure. If the tapping time varies within a wide range, this causes the outcome of the computer control to be very uncertain. For that reason, it is of paramount importance that the diameter of the tap hole remain as constant as possible during all tapping operations, which would not be the case if the tap hole repairs are carried out by previously employed and proposed procedures.

To sum up, with regard to the prior procedures that have been employed and proposed for repairing damaged tap holes heretofore, such procedures permit the steel converter to be used until the tap hole has become badly damaged, after which the steel converter is shut down for restoration of the tap hole. The repair of the badly damaged hole is achieved by use of molds or forms, jugs and the like or by slowly moving a housing through the tap hole opening to discharge the repair material against the damaged wall, or by use of other apparatus which will enable a worker to build up the tap hole wall. The shutting down of the converter to the extent required to effect the repair of the tap hole is obviously, for the reasons given hereinbefore, both operationally and economically undesirable.

SUMMARY OF THE INVENTION

In the light of the foregoing, there is a real need to provide a method and apparatus for repairing eroded or otherwise worn tap holes in a converter that does not possess the disadvantages inherent with previously proposed repairing procedures. Such a procedure should provide a more controlled and constant tapping time as well as provide a repairing procedure that can achieve the repairing of the tap hole in an extremely short and efficient time without a shutting down of the converter. Thus, the repair time per tapping operation will be considerably shorter on an average time thereby insuring a more efficient and economical operation of the converter to achieve a more desirable steelmaking production. Moreover, the procedure employed should be one that is not harmful to the health and safety of the working personnel.

In the attainment of these ends, it has been found that all of the foregoing disadvantages inherent with prior methods and apparatus may be eliminated when utilizing the method forming the basis of the present invention. The present invention is predicated on the proposition that, after each increase in the diameter of the tap hole in the converter by a minimum of about 1 to 2 mm up to a maximum increase of about 4 to 5 mm as a result of molten metal passing therethrough, the diameter of the tap hole will be restored to its original dimensions by a particular spraying procedure in which a refractory mortar material or cement is sprayed in a particular manner onto the eroded tap hole wall while it is in a hot state as a result of the tapping of the converter utilizing a spraying lance which is moved from outside the converter to a close proximity of the tap hole wall. Surprisingly, it has been found possible that utilizing the spraying procedure of the present invention to build up a layer of refractory material in this manner on the eroded tap hole wall will result in an excellent bond therebetween, notwithstanding the fact that the refractory material has been sprayed against the top hole wall from such a very short or close distance.

Prior to the present discovery, it was thought that as a result of the very close distance between the spraying head of the lance and the eroded tap hole wall receiving the repair material, the material sprayed on the tap hole wall would bounce back from the tap hole wall or that a bad bond would be created between the repair material and the tap hole wall or, at best, that the formed build-up layer of repair material would be quite porous and thus ineffective. Surprisingly, it has been found, in accordance with the present invention, that none of these deleterious effects occurred but rather, to the contrary, it was found that a very dense coating was bonded on the tap hole wall which was found to be of a quality comparable to that of the original material of the tap hole brick.

The present invention utilizing the spraying of the repair material from a spraying lance in close proximity to the eroded tap hole to build up the wall thereof in accordance with the present invention has many advantages. Due to the fact that the eroded tap hole is repaired from outside the converter, the operating personnel is subjected only to a very low degree of heat radiation from the converter which in no way will be harmful to the health of the worker or create any material discomfort to him. Moreover, the need for complex and heavy apparatus, e.g., the heavy and unmanageable spoon user near the converter mouth, as employed in the mold procedure, is eliminated. As a result, the repairing of the damaged tap hole can be effected very rapidly and simply without the necessity of employing expensive apparatus or of molds or the like to be positioned in the tap hole or mounted on the converter wall.

The most important advantage of the method forming the basis of the present invention, however, resides in the fact that almost each tapping operation can take place with approximately the same tapping time, which time, moreover, may be chosen to be as short as can be maintained from the standpoint of tapping techniques and as is desired from metallurgical requirements. As another advantageous result, this leads to a saving of time in the total charging cycle for the steel which will result in shortening the contact time between the corrosive slag and the converter wall which, in turn, will result in a longer lifetime for the converter wall lining. Thus, tap holes which are repeatedly repaired in accordance with the method of the present invention will be found to be able to last the entire lifetime of a converter lining. This fact, therefore, will render it unnecessary to take the converter out of operation during a long period of time for repair of the tap hole alone while the converter lining is still sufficiently intact for the operation thereof.

Depending on the nature of the material used in forming the tap hole, corrosiveness of the slag present on the molten steel and the diameter size selected for the tap hole, the wearing or eroding of the tap hole wall will be found to wear away at varying rates. However, an optimum operation can be achieved in accordance with the present invention if the tap hole wall is sprayed after each tapping operation to a hole diameter size corresponding with that for the minimum tapping time required for the operation of the converter. For a worker skilled in the arts, the minimum tapping time required in a converter operation is a known property. For example, this tapping time may be determined on the basis of known data such as the capacity of the converter, the metallurgical requirements called for in the ultimate product, and the corrosiveness of the steel slag. To illustrate these properties quantitatively, a steel converter having a capacity of about 300 tons, when producing steel having the usual properties and having a low carbon content, will have a tap hole whose diameter will be about 200 mm.

It is possible, in accordance with the present invention, to repair the eroded tap hole while the converter is in a tilted position. In such a situation, it is possible to move the spraying lance into the still very hot tap hole of the converter by means of a vertical movement. It might seem at first glance that this procedure would be preferable since the temperature of the wall of the tap hole would be in such circumstance as high as possible, so that a rapid bonding, sintering or the like of the repair material that had been sprayed onto the wall of the tap hole could be expected. It has, however, been found that a comparable coating layer of repair material having fully equivalent degrees of hardness and resistance properties against wear can be obtained if the wall of the tap hole has a somewhat lower temperature, namely, the temperature which the wall would have after the converter has been tilted back into the vertical position from the inclined position.

In accordance with the present invention, it has also been found in many instances to be preferable to spray the repair material onto the wall of the hole while the converter is in a vertical position during the same period in which the converter is being filled with additional raw materials for use in the normal process to be carried out in the converter and/or during the oxygen blowing step of the steel making process. This will be found to be advantageous because the spraying operation to repair the eroded tap hole during this period does not take any additional time which would not otherwise be used for the normal process because the spraying operation would be taking place simultaneously with another operation which would be part of the normal operating cycle of the converter. Moreover, it will be found that when the converter is in the vertical position the positioning and the movement of the jet lance may be carried out in a manner and by means which will provide a more simple operation.

Jet lances for spraying refractory mortar or cement are known as such. In essence, they may consist of a straight tube which is bent near its free end about an angle of about 90°. It is possible to employ such a lance when utilizing the invention for the repairing of the wall of the tap hole. Such an operation would necessitate the lance to be employed so as to impart a rotating movement to the lance which should be very accurately controlled with respect to the longitudinal movement of the lance with respect to the tap hole so as to avoid the formation of helical ribs and grooves in the repair material sprayed onto the eroded wall of the tap hole. It has been found that the requirement for such a careful control of the movement of the lance can be eliminated when carrying out the method of the present invention if the spraying operation takes place utilizing a jet lance whose spray is circularly symmetrical and which will be centrally moved in a longitudinal direction within the tap hole. This manner of spraying, moreover, has the further advantage that the repair material will be simultaneously sprayed over an entire periphery of a circle of the wall of the tap hole thus enabling the spraying operation to be carried out in a short period of time.

Further, in accordance with the present invention, it has been found that good results are also obtainable if the spraying operation takes place utilizing a lance having a diversing jet which is positioned before the tap hole centrally in a longitudinal direction. This is a more simple and more surprisingly efficient operation since such a procedure will be found to give an equal layer of mortar within the tap hole on the inner wall thereof. It is believed that the reason that it is possible to effectively repair an eroded tap hole by utilizing a jet nozzle placed in close proximity to but not within the eroded tap hole is that a very high temperature exists in the converter during its operation as well as there being a turbulent gas flow inside the converter during the filling thereof and during the start-up of the oxygen blowing. Thus, such conditions of high temperatures and high turbulence within the interior of the converter create a velocity or head pressure that is quite high whereas the static pressure inside the converter is lower than the static pressure outside. The static pressure determines, at least in part, the air flow through the tap hole into the converter. Thus, the pressure differential between the interior and the exterior of the converter will create a strong air suction action into the converter through the tap hole. Thus, the repair material which is sprayed outwardly in a diverging direction will be inwardly drawn into the tap hole by a strong suction effect and will be impinged against the periperal wall of the eroded tap hole to restore it to its original dimension. This procedure of repairing the tap hole by placing the jet nozzle exteriorly of the tap hole would not work satisfactorily against a badly eroded tap hole.

The jet nozzle to be employed in this embodiment may be of any desired construction that will spray the repair material outwardly in a diverging path forming an axially symmetrical jet of mortar repair material. One embodiment of a jet nozzle that has been found to be of particular utility is in the form of a simple tube having one end open from which the mortar material will be sprayed out axially therefrom in a diverging jet spray. The end face of the tube wall at the open end thereof will preferably be substantially perpendicular to the longitudinal or axial direction of the tube. The jet nozzle unit of this construction will permit the repair material to emerge freely from the open end of the tube in an axially diverging spray and will be sucked into the tap hole opening. It is preferred that the tube be kept substantially stationary outside of and centrally to the tap hole being repaired. This will permit the repair material to more easily and uniformly adhere to the wall surface of the tap hole.

It is possible that in many instances, as a result of the erosion of the tap hole, the wall of the tap hole will become irregular or non-circular in configuration. In such circumstances, it will be found, in accordance with the present invention, preferable to combine the spraying operation with a reaming operation of the wall of the tap hole before the spraying operation begins. To accomplish this purpose, it will be found desirable to provide the head of the jet lance to be employed in the spraying of the mortar material with a reamer. The reamer will be first moved through the hole to and fro to round out the hole, after which the jet lance will be operated to begin the discharge of the mortar material to carry out the desired repair.

Good results are obtainable, in accordance with the present invention, with a mortar material which is a dispersion of refractory material in a fine granular or powdered form in a liquid. Such mortar materials are known for spraying refractory layers onto walls. For jet operations with such mortar materials, the general practice is to prepare the dispersion of the refractory material shortly before use in the desired quantity. In this manner, the preparation of this small quantity of mortar material to be sprayed should take place each time during the refining cycle in the steel converter. It has, however, been found, in accordance with the present invention, that it is preferable to prepare the mortar material to be sprayed simultaneously with the spraying itself by formulating the dispersion by a simple mixing of the dry powdery refractory material with a liquid. This allows the two components of the mortar material to be sprayed to be stored, e.g., in hoppers, and no special measures have to be taken to keep the dispersion in the correct condition.

When applying this type of refractory mortar, a preferred composition is one in which the refractory component of the mortar material is primarily burned magnesite, or so-called seawater-magnesite, and the preferred liquid component is water, the amount of the latter being preferably present in an amount of about 12 to 20% of the mortar. The bonding properties of the mortar material sprayed onto the tap hole wall may be improved by adding a chromate binder to the magnesite mass.

The bonding capacity of the motor material sprayed onto the tap hole wall may, however, also be achieved in another manner than by combining the refractory component with a liquid such as water. It is possible, in accordance with the present invention, to have the mortar material to be sprayed on the tap hole wall to be composed of a mixture of finely divided refractory material and ground tar pitch, which material is preferably sprayed by combining same with the gaseous fluid. Good results are also obtainable, in accordance with the present invention, if the refractory mass is primarily made up of ground burnt dolomite. An additional improvement may be obtained with the methods employed in accordance with the present invention, in many instances, if a dry refractory ceramic component is first propelled onto the tap hole wall by means of a gaseous fluid before the actual repairing occurs. This pretreatment imparts a kind of sand blasting effect to the tap hole wall which will also give an improvement to the bond of the refractory material onto the tap hole wall. However, it will be found that such pretreatment will only be necessary in very exceptional cases.

The present invention not only relates to methods as hereinbefore described for maintaining and repairing an eroded tap hole as given above, but also is directed to a device or apparatus for use in carrying out said methods. The device or apparatus that may be employed in the practice of the present invention is of the type that is generally known and includes a jet lance and a supporting and guiding system therefor. Such devices or apparatus have been proposed heretofore for spraying refractory material into metallurgical containers or onto metallurgical vessel walls. It has been noted hereinbefore that it is readily predictable that with a jet lance of a known construction that good results can be obtained when spraying material onto the wall of a tap hole and, in general, it should be noted that it would not be obvious that such spraying would be possible in such a small or circumferentially narrow space. It has, however, been found that excellent results are obtainable with the aid of a device in accordance with the present invention if such device is characterized in that the jet lance is provided at its free end with a central searching head and a circularly symmetrical spraying head coaxially therewith. Also, as hereinbefore indicated, a jet lance may be employed exteriorally of the eroded tap hole in which the jet lance will impart a diverging spray of mortar material.

In those cases in which the tap hole wall is so damaged so as to have an irregular shape, it is possible to pretreat the tap hole first in order to impart a cylindrical shape thereto. This pretreatment may be achieved with the aid of a reamer or similar tool which can be a separate tool which is moved back and forth through the tap hole first before the spraying tool is advanced. It is, however, preferred to use a device in accordance with the present invention in which the head of the spraying lance is also provided with a reamer, a scraper or a similar tool.

When using jet lances for spraying in metallurgical vessels heretofore, the usual practice has been to mount the jet lance on a car or carriage which can move over a suitable operating floor into position from which the spraying operation will take place. In such an operation, the jet lance will be connected through a flexible hose to a container in which the mass to be sprayed is kept. This method does not give any particular difficulties when a dry mortar is sprayed with the aid of a gaseous fluid. For a mortar material in the form of a dispersion in a liquid, it is preferable, as hereinbefore noted, at least in many cases, not to prepare the mortar mass to be sprayed beforehand in a storage container. As a result thereof, it would be found desirable that the supporting and guiding system should also include several hoppers or the like or should be connected to a plurality of such hoppers. However, such an arrangement would result in a cumbersome plant which would be difficult to move and which would hamper the operating personnel by being in their way when not in use.

Therefore, a preferred embodiment of a device or apparatus to be employed in the practice of the present invention is one in which the jet lance is suspended in the guiding system and is movable upwardly therewith, said jet lance being connected to two hoppers, one for the solid material and the other for the liquid component of the repair material. The hoppers will be positioned above the top of and to the side of the converter and the spraying lance would also be connected to a source of gaseous fluid under pressure.

It has also been found, in accordance with the present invention, that an optimum composition of the mixture of dolomite and pitch is possible. If too little pitch is used, the mixture does not stick sufficiently to the tap hole wall and a good bond will not be obtained after the cooking of the pitch occurs as a result of the heat of the process. If too much pitch is used, the finally repaired tap hole will be found to be too porous and too weak. A mixture is therefore preferred which contains between 10 and 30% of pitch and preferably about 15% of pitch. The ground pitch should further contain the sieve fractions of sizes between 0.2 mm and 2.0 mm. The refractory mass that imparts the best results is one that has a grain size for all or almost all of the particles used below 4 mm. In particular, the given sizes of the sieve fraction of the pitch should be present in a quantity of more than 80% of the total quantity of pitch and, moreover, it is preferable to have at least 80% of the refractory mass possess a grain size of less than 2 mm. The pitch to be employed is identified by a few physical and chemical characteristics. Good results were obtained with a pitch which possessed the following properties:

A quantity of volatile constituents of about 2%
A quantity of water of about 0.1%
A softening fraction at 68° C. of about 90%
A content of $C_2$ resins of 25–30%
A specific gravity at 20° C. of 1.30 to 1.32 grams per cubic centimeter.

The determination of the softening fraction of the pitch is, in this case, done according to the so-called K- and S-method, the quantity of $C_2$-resins being determined as the difference between the percentage of non-soluble constituents of the pitch after dissolving thereof in toluence and in pyridene, respectively.

BRIEF DESCRIPTION OF THE DRAWINGS

The invention will now be illustrated in more detail with reference to the accompanying drawing wherein FIG. 1 gives, in general and diagrammatically, an illustrative embodiment of a device made in accordance with the present invention shown in association with a converter with which the device is to be used to effect the repairing of a tap hole.

DESCRIPTION OF THE PREFERRED EMBODIMENT

Figure 1:
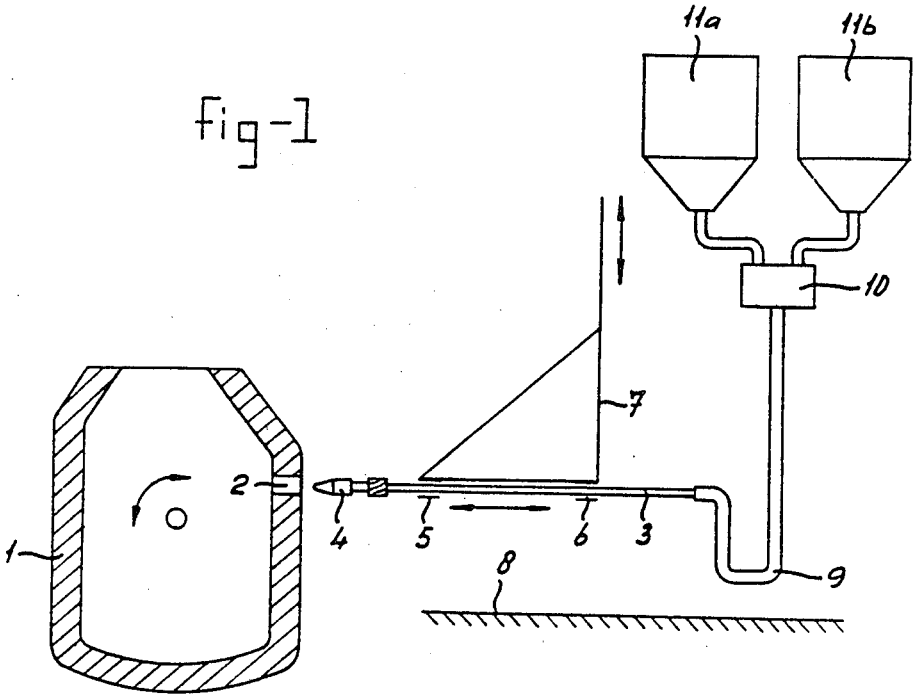

In FIG. 1, reference numeral 1 indicates diagrammatically a steel converter of the type used for the refining of pig iron to steel by blowing oxygen onto a molten bath thereof. The converter is tiltable in the directions of the arrow into a position in which the tap hole, generally indicated by reference numeral 2, will be directed downwardly. In that position, the refined metal product can be tapped by having the flow of molten metal pass therethrough.

For repairing the wall of the tap hole 2 after same has become eroded by the passage of the molten metal therethrough, a jet lance 3 is used, said lance 3 being provided with a spraying head 4 at the forward end thereof. The lance 3 is displaceable in longitudinal direction with respect to the tap hole 2 by positioning same in bearings 5 and 6 which are secured to a supporting frame 7 longitudinally spaced from the converter. The frame 7 is in the form of a light steel frame structure and is movable up and down vertically in the direction of the vertical arrow shown in FIG. 1 along suitable guide means which are not shown. During the refining process and during the tapping of the converter, the supporting frame 7 will be in its highest or uppermost position so that the floor 8 of the steel mill will be unencumbered and safe for use by mill personnel.

The jet lance 3 is connected at its opposite end by means of a flexible hose 9 to a mixing device 10 which, in turn, is connected to two hoppers **11*a* and 11*b*. In hopper 11*a*, a mixture of magnesite powder with a binder is stored, and hopper 11*b* contains a liquid which, when mixed with the magnesite powder from hopper 11*a*, will form the repair material dispersion to be sprayed through the head 4 of the lance 3**.

Figure 2:
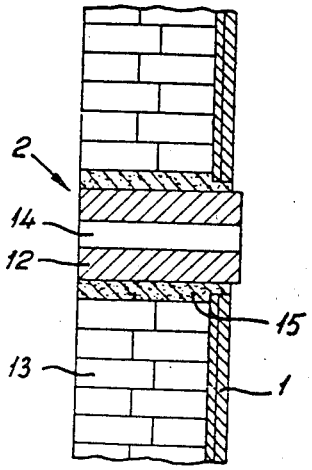
FIG. 2 is an enlarged fragmentary cross-sectional view of the tap hole shown in the converter illustrated in FIG. 1.

FIG. 2 shows that within the steel outer lining of the converter 1 there is a brick structure 13 which may be made from magnesite or of dolomite bricks. A tap hole brick 12 having a central tap hole 14 formed therein is positioned in the brick lining 13 and is held in place by means of refractory mortar rammed into the surrounding space, such mortar being indicated by reference numeral 15.

Figure 3:
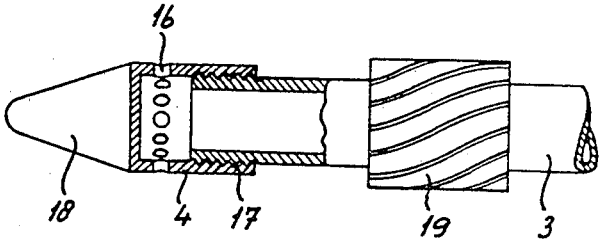
FIG. 3 is an enlarged fragmentary cross-sectional view of one form of the spraying lance that is shown in FIG. 1 that may be employed in the practice of the present invention and illustrates in greater detail the particular end construction of this illustrative embodiment of a spraying lance.

In FIG. 3, the free end of the illustrative jet lance 3 is shown in greater detail. The spraying head 4 is secured to the tubular part of lance 3 with the aid of a screw threaded portion 17. In the periphery of the spraying head 4, there are a considerable number of bores 16 closely spaced to one another over the entire periphery thereof through which bores 16 the repair material will be sprayed circumferentially outwardly. The distance between these bores 16 is chosen so that a substantially uninterrupted circular jet of repair material from the spraying head impinges on the wall of the bore or tap hole 14 in the tap hole brick 12. The front face of the spraying head 4 is provided with a searching head 18 which facilitates the introduction of the head 4 into tap hole 14. A reamer 19 is mounted on the lance 3 rearwardly of the head 4, said reamer having a diameter which will be somewhat larger than the desired diameter of tap hole 14 so as to facilitate the reaming of the tap hole 14 when required.

To maintain the proper size and configuration of the tap hole each time after the tapping of the converter has been completed and returned to its vertical position so that it may be filled again, the jet lance 3 is first moved to and fro through the tap hole 14 so that reamer 19 will pass through both ends of the tap hole 14 so as to make the hole configuration sufficiently cylindrical again even it it has deviated considerably from its normal cylindrical shape. Upon the completion of the reaming operation, the powdery component from hopper 11*a* is blown through the lance 3 by means of air under pressure. Simultaneously, the spraying head 3 having the bores 16 therein is moved to and fro within the axial length of the tap hole 14 so that the wall of the tap hole will be additionally cleaned by the sand blasting effect created by the refractory material which is blown with considerable speed and thus considerable impact against the wall of the tap hole 14. it is to be noted that, depending upon the condition of the tap hole 14 before the repairing operation is carried out, either the reaming operation or the sand blasting operation, or both, may be omitted. If it appears repeatedly that either one or both of these operations are superfluous, it would therefore be possible to omit the reamer 19 from the lance 3, as well as omit the blowing of the powdery component with air under pressure against the tap hole wall.

After the tap hole 14 has been prepared in the manner described above or has not be subject to a reaming and blasting operation, the powdery and liquid components are supplied simultaneously from hoppers 11*a* and 11*b* to the mixer 10 in the desired mixing ratio, after which the dispersion formed in the mixer 10 is pumped to the spraying head 4 of the lance 3. The spraying head 4 is moved to and fro in an axial direction with the spraying bores 16 within the tap hole 14 and over the axial length of the tap hole until a layer having a thickneww of at least about 1 to 2 mm of refractory material, but not in excess of about 5 mm thick, has been sprayed with the spraying bores 16 onto the wall of the tap hole 14. The supply of components from hoppers 11*a* and 11*b* to the mixer 10 is stopped, the jet lance 3 is withdrawn from the tap hole 14 and thereafter moved upwardly in the direction of the vertical arrow shown in FIG. 1. The converter may then be filled or oxygen blasting continued or the next cycle of operation undertaken from the tap hole 14.

I claim:

1. A method of regulating the tapping time of a steel converter by maintaining the tap hole diameter thereof by repairing the tap hole present in the side wall of a steel converter to restore same to a preselected diameter after the diameter thereof has been increased between about 1–5 mm by reason of molten steel passing therethrough during a tapping operation, said method comprising moving elongated jet spray means centrally into the eroded tap hole present in the side wall of the converter after the diameter thereof has been increased between about 1 to 5 mm and while the tap hole present in the side wall of the converter is still hot as a result of the tapping of the converter, spraying refractory mortar material radially outwardly in a simultaneously circular direction onto the eroded surface of the inner periphery of the wall forming the tap hole to restore the diameter of the tap hole to approximately its preselected diameter and thereafter withdrawing said jet spray means from the tap hole.

2. A method in accordance with claim 1, wherein the tap hole is subjected to a reaming operation to render said tap hole substantially circular in configuration prior to using said jet spray means.

3. A method in accordance with claim 1, wherein prior to said spraying operation said tap hole is first cleaned by blowing a dry refractory cement under air pressure against the periphery of the wall forming the tap hole.

4. A method in accordance with claim 1, wherein prior to the spraying operation said tap hole is first subjected to a reaming operation to render said tap hole substantially circular in configuration and thereafter subjecting said tap hole to a cleaning operation by blowing a dry refractory cement under air pressure against the periphery of the wall forming the tap hole.

5. A method in accordance with claim 1, wherein the mortar material is a dispersion of refractory mortar material in a liquid medium.

6. A method in accordance with claim 1, wherein the mortar material is formed into a dispersion simultaneously with the spraying thereof by mixing said dry refractory material with a liquid.

7. A method in accordance with claim 1, wherein the mortar material consists essentially of calcined magnesite and water, said water constituting 12 to 20% of the sprayed material.

8. A method in accordance with claim 1, wherein the mortar material consists essentially of a mixture of refractory mortar in which at least 80% thereof has a grain size of less than 2 mm and from 10 to 30% ground tar pitch and a gaseous fluid.

9. A method in accordance with claim 1 wherein the elongated jet spray means is moved into the eroded tap hole after the converter has been placed in a vertical state after a tapping operation, or oxygen is being blown thereinto.

10. A method of regulating the tapping time of a steel converter by maintaining the tap hole diameter thereof by repairing the tap hole present in the side wall of a steel converter to restore same to a preselected diameter after the diameter thereof has been increased between about 1 to about 5 mm by reason of molten steel passing therethrough during a tapping operation, said method comprising moving elongated jet spray means at least in close proximity to the tap hole present in the side wall of the converter after the diameter thereof has been increased between about 1–5 mm and while the tap hole present in the side wall of the converter is still hot as a result of the tapping of the converter, spraying refractory mortar material outwardly in a diverging spray onto the eroded surface of the inner circumference of the wall forming the tap hole to restore the diameter of the tap hole to approximately its preselected diameter and thereafter withdrawing said jet spray means from the tap hole.

11. A method in accordance with claim 10 wherein the jet spray means is placed in close proximity to but not within the eroded tap hole during the repairing thereof.

12. A method in accordance with claim 10 wherein the elongated jet spray means is moved at least in close proximity to the eroded tap hole after the converter has been placed in a vertical state after a tapping operation and the converter is receiving raw matter or oxygen is being blown thereinto.

* * * * *